US012245727B2

(12) United States Patent
Thomson

(10) Patent No.: US 12,245,727 B2
(45) Date of Patent: Mar. 11, 2025

(54) TOILET MODULE

(71) Applicant: Stephen John Thomson, Victoria (AU)

(72) Inventor: Stephen John Thomson, Victoria (AU)

( * ) Notice: Subject to any disclaimer, the term of this patent is extended or adjusted under 35 U.S.C. 154(b) by 506 days.

(21) Appl. No.: 17/629,028

(22) PCT Filed: Jul. 24, 2020

(86) PCT No.: PCT/AU2020/050752
§ 371 (c)(1),
(2) Date: Jan. 21, 2022

(87) PCT Pub. No.: WO2021/012008
PCT Pub. Date: Jan. 28, 2021

(65) Prior Publication Data

US 2022/0265101 A1 Aug. 25, 2022

(30) Foreign Application Priority Data

Jul. 25, 2019 (AU) ..... 2019902634

(51) Int. Cl.
*A47K 17/02* (2006.01)
*A47K 17/00* (2006.01)
(Continued)

(52) U.S. Cl.
CPC ..... *A47K 17/028* (2013.01); *E03D 11/04* (2013.01); *E03D 11/13* (2013.01); *A47K 2017/006* (2013.01)

(58) Field of Classification Search
CPC .. A47K 17/028; A47K 2017/00; E03D 11/04; E03D 11/12; E03D 11/125; E03D 11/13; A61G 7/02; A61G 7/1007
(Continued)

(56) References Cited

U.S. PATENT DOCUMENTS 2,928,104 A 3/1960 Kennedy
3,919,726 A 11/1975 Godwin et al.
(Continued)

FOREIGN PATENT DOCUMENTS

CA 2 613 173 C 7/2013
CN 200999385 Y 1/2008
(Continued)

OTHER PUBLICATIONS

DE202004010480U1 Machine Translation (Year: 2024).*
(Continued)

*Primary Examiner* — Erin Deery
*Assistant Examiner* — William R Klotz
(74) *Attorney, Agent, or Firm* — NIXON & VANDERHYE

(57) ABSTRACT

Disclosed is a toilet module having a toilet bowl and which also has a toilet bowl support mechanism. The toilet bowel support mechanism allows the toilet bowl to be moved to a position in which the person using the toilet to adopt more of a squatting posture when cleansing their bowels. The toilet bowl support mechanism can move the toilet bowl to and between a first position and a second position, the first position is characterised in that the front end of the toilet bowl is lower than the aft end of the toilet bowl, and the second position is characterised in that the front end of the toilet bowl is above the aft end of the toilet bowl. The first position makes it easier for folk with limited mobility to sit on the toilet, and the second position allows the seated person to adopt a squatting posture.

21 Claims, 6 Drawing Sheets

(51) Int. Cl.
*E03D 11/04* (2006.01)
*E03D 11/13* (2006.01)

(58) Field of Classification Search
USPC ..... 4/254, 420
See application file for complete search history.

(56) References Cited

U.S. PATENT DOCUMENTS

| | | | | |
|---|---|---|---|---|
| 4,045,827 | A | 9/1977 | Morris et al. | |
| 4,091,473 | A * | 5/1978 | Matthews | E03D 11/125 4/300 |
| 4,254,514 | A | 3/1981 | Sakamoto | |
| 4,726,079 | A * | 2/1988 | Signori | E03D 11/125 4/312 |
| 5,311,617 | A * | 5/1994 | Ammatelli | A47K 13/10 4/237 |
| 5,321,857 | A | 6/1994 | Lataillade | |
| 5,666,673 | A | 9/1997 | Ammatelli et al. | |
| 5,809,583 | A | 9/1998 | Pucciani | |
| 5,960,483 | A | 10/1999 | Delzer et al. | |
| 6,070,276 | A | 6/2000 | Yeung | |
| 6,148,448 | A | 11/2000 | Urso | |
| 6,189,164 | B1 * | 2/2001 | Krapu | A61G 5/14 297/DIG. 10 |
| 6,553,582 | B1 | 4/2003 | Clark | |
| 6,598,246 | B1 * | 7/2003 | Shou | A61G 7/1094 297/DIG. 10 |
| 8,336,130 | B1 * | 12/2012 | Cardenas | A47K 13/10 4/252.2 |
| 8,707,473 | B2 | 4/2014 | Rane | |
| 9,278,037 | B1 * | 3/2016 | Primus | E03D 11/16 |
| 10,292,549 | B2 | 5/2019 | Kim | |
| 10,428,508 | B1 * | 10/2019 | Hudson | E03D 11/125 |
| 2007/0011801 | A1 | 1/2007 | Dubois | |
| 2008/0005829 | A1 | 1/2008 | Chen | |
| 2010/0229293 | A1 * | 9/2010 | Rodgers | A61G 7/1019 4/246.1 |
| 2013/0340156 | A1 | 12/2013 | Mchale et al. | |
| 2018/0325337 | A1 * | 11/2018 | Kim | A47K 17/02 |
| 2019/0070052 | A1 * | 3/2019 | Humbert | A47K 13/105 |
| 2020/0095757 | A1 * | 3/2020 | Schwab | E03D 11/125 |
| 2020/0393442 | A1 * | 12/2020 | Hall | A47K 17/028 |
| 2021/0030221 | A1 * | 2/2021 | Johnson | A47K 13/005 |

FOREIGN PATENT DOCUMENTS

| | | | | |
|---|---|---|---|---|
| CN | 201092681 | Y | 7/2008 | |
| CN | 101037872 | B | 4/2011 | |
| CN | 203129309 | U | 8/2013 | |
| CN | 103967103 | A | 8/2014 | |
| CN | 205421475 | U | 8/2016 | |
| CN | 205712391 | U | 11/2016 | |
| CN | 107083798 | A | 8/2017 | |
| CN | 206503208 | U | 9/2017 | |
| CN | 206538836 | U | 10/2017 | |
| CN | 108118768 | A | 6/2018 | |
| DE | 202004010480 | U1 * | 10/2004 | E03D 11/12 |
| DE | 20 2007 008 423 | U1 | 9/2008 | |
| DK | 201770490 | | 1/2019 | |
| EP | 0 413 063 | A1 | 2/1991 | |
| EP | 2 448 461 | A2 | 5/2012 | |
| JP | H03-66846 | | 3/1991 | |
| JP | 2000-104321 | A | 4/2000 | |
| JP | 2008-267002 | A | 11/2008 | |
| JP | 4321322 | B2 * | 8/2009 | E03D 11/02 |
| JP | 2010-138696 | A | 6/2010 | |
| JP | 2011-038386 | A | 2/2011 | |
| JP | 4927107 | B2 | 5/2012 | |
| JP | 5906415 | B2 | 4/2016 | |
| KR | 20080003614 | A * | 1/2008 | E03D 11/125 |
| KR | 10-2008-0015644 | A | 2/2008 | |
| KR | 10-2008-0113003 | A | 12/2008 | |
| KR | 10-2009-0076869 | A | 7/2009 | |
| KR | 10-1176335 | B1 | 8/2012 | |
| WO | WO-9738176 | A1 * | 10/1997 | E03D 11/02 |
| WO | 02/08529 | A1 | 1/2002 | |
| WO | 2005/080700 | A1 | 9/2005 | |
| WO | WO-2009073935 | A2 * | 6/2009 | E03D 11/143 |
| WO | 2010/142368 | A2 | 12/2010 | |
| WO | 2011/098620 | A1 | 8/2011 | |
| WO | 2012/064077 | A2 | 5/2012 | |

OTHER PUBLICATIONS

JP4321322B2 Machine Translation (Year: 2024).*
KR20080003614A Translation (Year: 2024).*
Office Action issued in Indian Patent Application No. 202247007842 dated Feb. 6, 2023.
International Search Report for PCT/AU2020/050752, mailed Sep. 15, 2020, 4 pages.
Written Opinion of the ISA for PCT/AU2020/050752, mailed Sep. 15, 2020, 5 pages.

* cited by examiner

TOILET MODULE

FIELD OF THE INVENTION

This invention relates to improvements in toilet modules, and in particular, but not exclusively to improvements relating to toilet modules for the purposes of improving posture during bowel cleansing and making it easier to sit on and lift away from the toilet seat of a toilet module.

BACKGROUND

There are two main types of toilet modules in the world, squatting toilet modules that are used mainly in eastern countries and seated toilet modules that are used mainly in western countries.

Both toilet module types have advantages and disadvantages. A significant disadvantage of the seated toilet module is that the posture of a seated person is not ideal for bowel cleansing. The puborectalis muscle which is intended to assist with continence chokes the anal canal when a person is standing or is seated. Squatting relaxes the puborectalis muscle and straightens the anal canal in preparation for bowel cleansing.

In addition, elderly or obese people sometimes find it difficult to lower themselves onto a conventional seated toilet module, or to adopt a squatting position. And this same group of people similarly find it difficult to lift themselves up from a toilet seat, or from a squatting position.

Seated toilet modules having a bowl to collect waste, a water trap, and which can be flushed to clean, are generally considered cleaner than squat toilets.

For the reasons noted above, what is needed is an improved toilet module that incorporates a seat and a bowl but which allows people to adopt something of a squatted position or posture while cleansing their bowels, while at the same time being accessible to those who find it difficult to lower themselves onto a seated toilet module or to lift away from a seated toilet module.

In this specification unless the contrary is expressly stated, where a document, act or item of knowledge is referred to or discussed, this reference or discussion is not an admission that the document, act or item of knowledge or any combination thereof was at the priority date, publicly available, known to the public, part of common general knowledge; or known to be relevant to an attempt to solve any problem with which this specification is concerned.

SUMMARY OF THE INVENTION

It is therefore an object of the present invention to provide improvements relating to toilet modules which will at least go some way towards overcoming one or more of the above mentioned problems, or at least provide the public with a useful choice.

Accordingly, in a first aspect, the invention may broadly be said to consist in a toilet module having a toilet bowl and a toilet bowl support mechanism, the toilet bowel being supported by the toilet bowl support mechanism; and the toilet bowl has a front end and an aft end, the front end and the aft end corresponding to the front and the back respectively of a person seated on the toilet module when the toilet module is in use, and the front end and the aft end each being situated at or adjacent an upper surface of the toilet bowl; and the toilet bowl support mechanism is configured to move the toilet bowl to and between a first position and a second position, the first position being characterised in that the front end of the toilet bowl is lower than the aft end of the toilet bowl, and the second position being characterised in that the front end of the toilet bowl is above the aft end of the toilet bowl.

Preferably the toilet bowl support mechanism is configured to rotate the toilet bowl about an axis of rotation that passes through a point that is situated at or adjacent the front end of the bowl.

Preferably the axis of rotation of the toilet bowl is parallel to a transverse axis of the toilet bowl.

Preferably the toilet bowl support mechanism includes one or more bowl guides configured to facilitate the movement of the toilet bowl to and between the first position and the second position.

Preferably the toilet bowl support mechanism includes a bowl structural support member that is rigidly connected to the toilet bowl at a first or forward part of the bowl structural support member and which has a slidable engagement with the or each bowl guide at a second or aft part of the bowl structural member.

Preferably the bowl structural support member provides a cantilevered support for the toilet bowl.

Preferably the or each bowl guide includes a curved section of guide.

Preferably the or each bowl guide is aligned in a substantially vertical orientation.

Preferably the curved section of the or each bowl guide is used to produce the rotational movement of the toilet bowl as the bowl structural support member slides along the curved section of the or each guide.

Preferably the toilet bowl is generally situated higher when in the first position when compared to the situation of the toilet bowl when in the second position.

Preferably the toilet bowl support mechanism includes at least one spring which is configured to bias the toilet bowl toward the first position.

Preferably the toilet bowl support mechanism includes one or more powered actuators configured to move the toilet bowl to and between the first position and the second position.

Optionally the toilet bowl support mechanism includes a manually operated actuator configured to move the toilet bowl to and between the first position and the second position.

Preferably the toilet bowl support mechanism includes a rack and pinion geared actuation system.

Preferably the or each bowl guide is in the form of a rail along which a carriage assembly can move.

Preferably the or each bowl structural support member is connected to a carriage assembly that moves along its associated bowl guide.

Preferably the toilet module further includes movable footrests and a footrest support mechanism that is configured to move the footrests to and between an upper position and a lower position.

Preferably the footrest support mechanism includes one or more footrest guides configured to facilitate the movement of the footrests to and between the upper position and the lower position.

Preferably the footrest support mechanism includes one or more footrest structural support members that are rigidly connected to each footrest at a first or forward part of the or each footrest structural support member and which have a slidable engagement with the or each footrest guide at a second or aft part of the or each footrest structural member.

Preferably the or each footrest structural support member provides a cantilevered support for the footrests.

Preferably the or each footrest guide includes a straight section of guide.

Preferably the or each footrest guide is aligned in a substantially vertical orientation.

Preferably the footrest support mechanism includes at least one spring which is configured to bias the footrests toward the upper position.

Preferably the footrest support mechanism includes one or more powered actuators configured to move the footrests to and between the lower position and the upper position.

Optionally the footrest support mechanism includes a manually operated actuator configured to move the footrests to and between the lower position and the upper position.

Preferably the footrest support mechanism includes a rack and pinion geared actuation system.

Preferably the or each footrest guide is in the form of a rail along which a carriage assembly can move.

Preferably the or each footrest structural support member is connected to a carriage assembly that moves along its associated footrest guide.

Preferably the or each footrest guide is an extension of the or each bowl guide.

Preferably the toilet module includes a trap configured to provide a water seal in a waste outlet passage of the toilet module.

Preferably the direction of flow through the trap is a direction that is parallel to the axis of rotation of the toilet bowl.

Preferably the trap includes a waisted section.

Preferably the waisted section is in the form of an hourglass shaped waisted section.

Optionally the trap includes a U-bend or an S-bend.

Preferably the toilet module includes a flexible connection that provides a water-tight connection between an outlet of the toilet bowl and a waste system in the vicinity of the toilet module.

Optionally the toilet module includes a seat having a concave upper surface when viewed as a side elevation.

In a second aspect, the invention may broadly be said to consist in a building or structure incorporating at least one toilet module substantially as specified herein.

The invention may also broadly be said to consist in the parts, elements and features referred to or indicated in the specification of the application, individually or collectively, and any or all combinations of any two or more of the parts, elements or features, and where specific integers are mentioned herein which have known equivalents, such equivalents are incorporated herein as if they were individually set forth.

BRIEF DESCRIPTION OF THE DRAWINGS

Further aspects of the present invention will become apparent from the following description which is given by way of example only and with reference to the accompanying drawings in which.

DESCRIPTION OF THE PREFERRED EMBODIMENTS

First Example

With reference to FIGS. 1 to 6, a first example of a toilet module (11) according to the present invention will now be described. The toilet module (11) has been designed for use in buildings such as rest homes or hospitals where it is not uncommon for people to have difficulty using conventional toilets. It is envisaged that the toilet module (11) could also be used in people's homes, or within other structures such as ships or aircraft if desired.

The purpose of the toilet module (11) is to provide a sanitary toileting apparatus that assists people in achieving a squatting position for the purpose of achieving a successful cleansing of their bowels. There are times when people have difficulty with this task, for example when they are unwell, or when aged. Obese people can also experience difficulty in this area. Squatting is known to assist with cleansing of the bowels, and this toilet module (11) provides an aesthetically acceptable, functional and hygienic apparatus that assists with the squatting process. The toilet module (11) is also suitable for people who find a conventional toilet module difficult to lower themselves onto, or to lift themselves away from. Those who need assistance in achieving a squatting position are often the same ones that require assistance getting onto or off a toilet seat.

Figure 1:
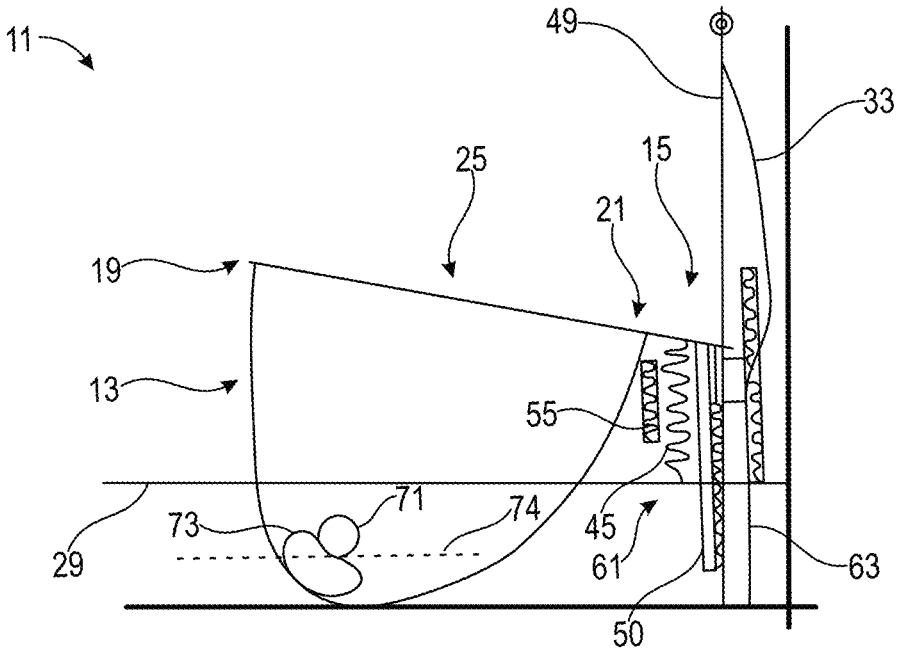
FIG. 1 is a side elevation view of a first example of a toilet module according to the present invention.
Figure 2:
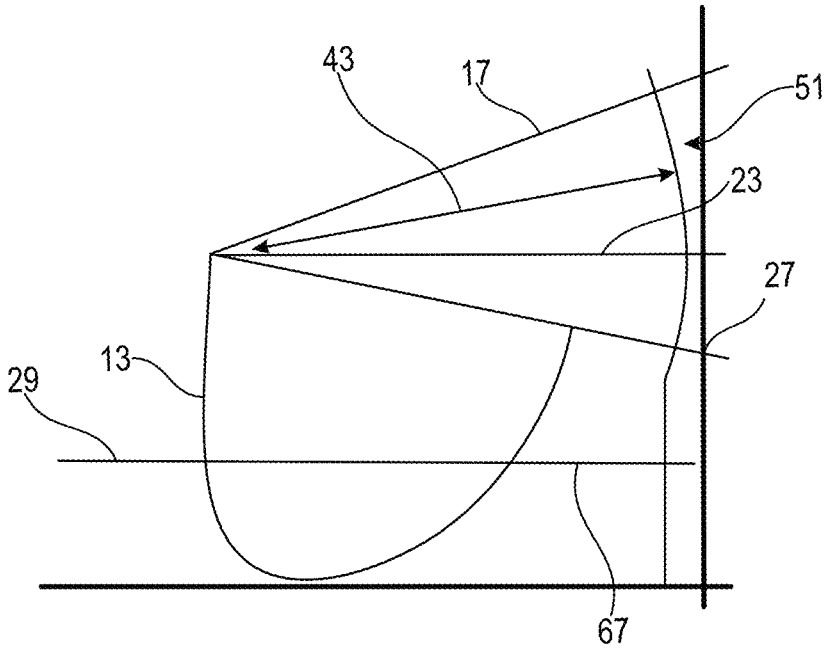
FIG. 2 is a side elevation view of the first example showing a range of angles of a toilet bowl of the toilet module.
Figure 3:
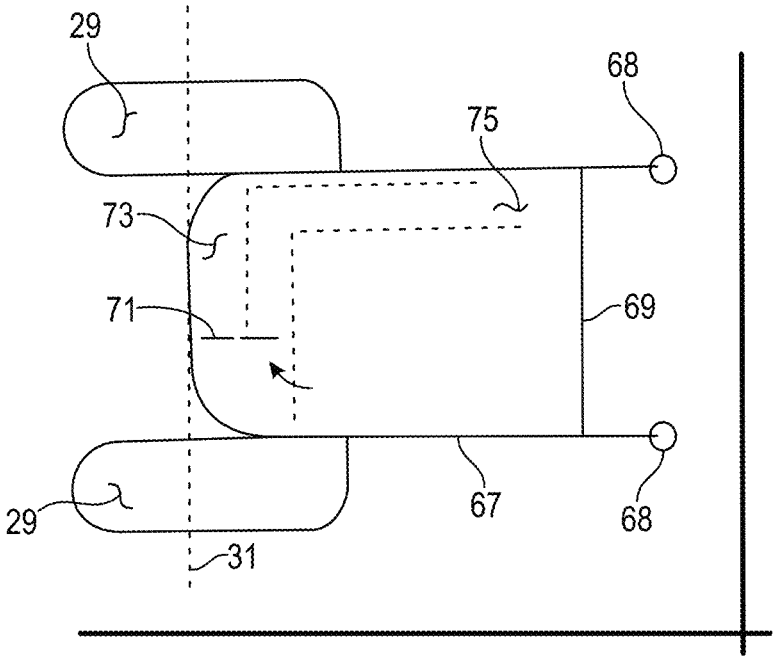
FIG. 3 is a plan view of the first example of a toilet module.
Figure 4:
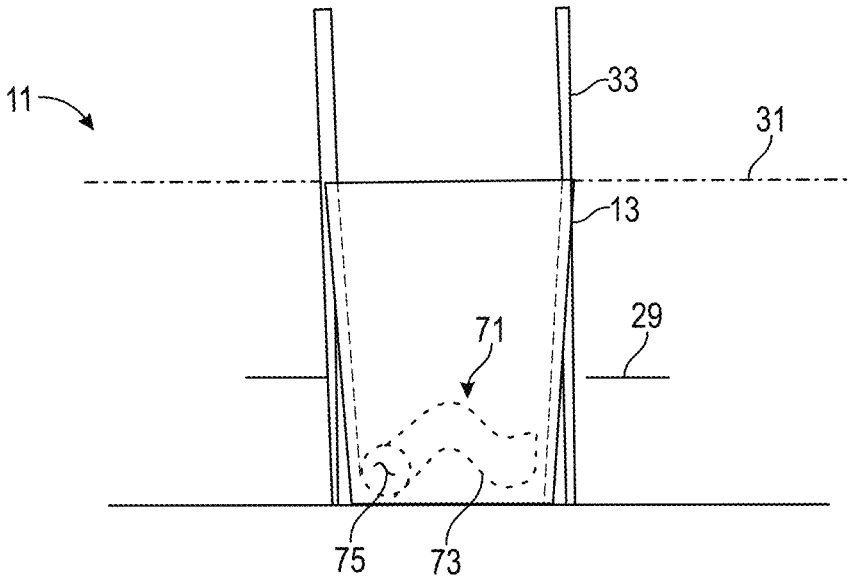
FIG. 4 is a front elevation view of the first example of a toilet module.
Figure 5:
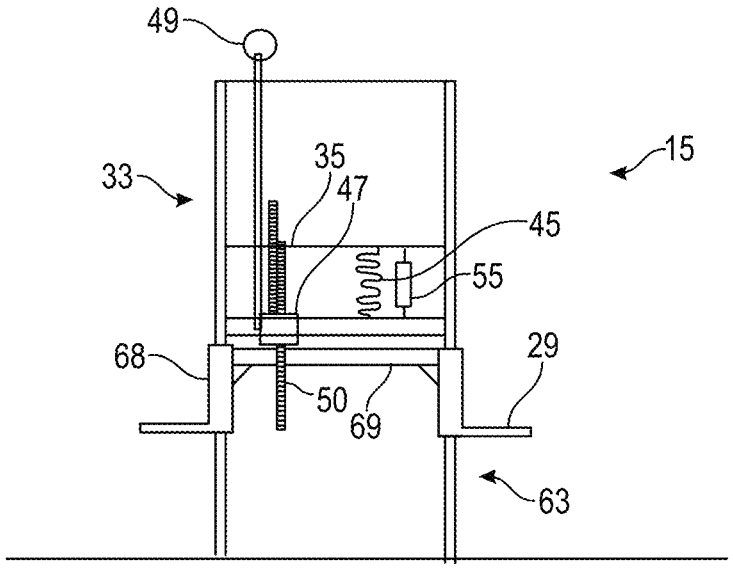
FIG. 5 is a cutaway front elevation view showing the operating mechanisms of the first example of a toilet module.
Figure 6:
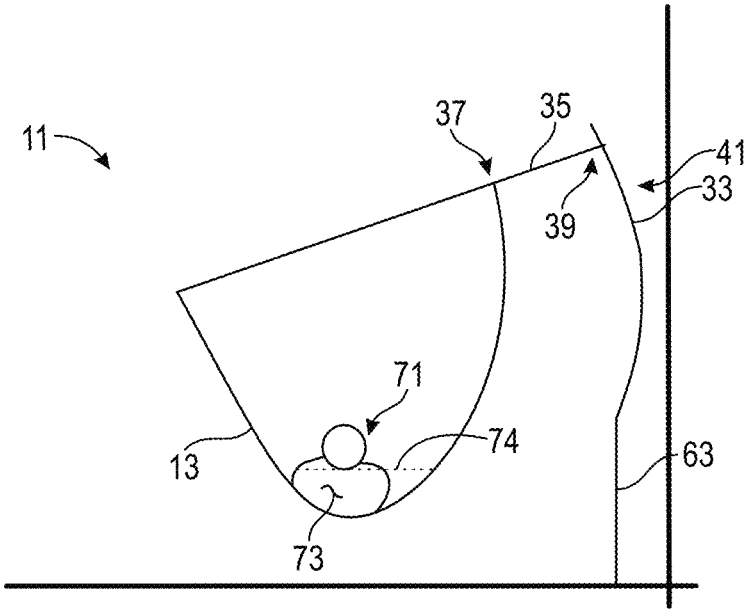
FIG. 6 is a side elevation view showing the first example of a toilet bowl at an upper end of its range of movement.

The toilet module (11) has a toilet bowl (13) and a toilet bowl support mechanism (15). The toilet bowel (13) is supported by the toilet bowl support mechanism (15), and the toilet bowl support mechanism (15) enables the toilet bowel (13) to be orientated at a range of angles. With reference to FIG. 2, it can be seen that the toilet bowl (13) can be oriented at a first angle (17) in which a front end (19) of the toilet bowl (13) is lower than an aft or rear end (21) of the toilet bowl (13). The toilet bowl (13) can also be oriented at a second angle (23) in which an upper surface (25) of the toilet bowl (13) is substantially level, and a third angle (27) in which the front end (19) of the toilet bowl (13) is higher than the aft end (21) of the toilet bowl (13).

It should also be noted that the toilet bowl support mechanism (15) is configured such that the toilet bowl (13) can be oriented and held at any angle between the first angle (17) and the third angle (27). In this example the first angle (17) is an angle of approximately twenty degrees above the horizontal, and the third angle (27) is an angle of approximately ten degrees below the horizontal. It is envisaged that angles in the range of thirty degrees above the horizontal to twenty degrees below the horizontal would be suitable for achieving the desired purposes of the toilet module (11).

As noted above, the toilet bowl support mechanism (15) is configured to move the toilet bowl (13) through and between a range of angles. When the toilet bowl (13) is oriented at the first angle (17) the toilet bowl (13) can be said to be in its first position. And when the toilet bowl (13) is oriented at the third angle (27) the toilet bowl (13) can be said to be in its second position.

The first position of the toilet bowl (13) is characterised in that the front end (19) of the toilet bowl (13) is lower than the aft end (21) of the toilet bowl (13), and the second position is characterised in that the front end (19) of the toilet bowl (13) is above the aft end (21) of the toilet bowl (13). The toilet bowl support mechanism (15) moves the toilet bowl (13) to and between the first position and the second position, When the aft end (21) of the toilet module is raised above the front end (19), for example when in the first position or orientated at the first angle (17), a person can mount the toilet module with greater ease in that they do not have to lower their body quite as far as when the upper surface (25) of the toilet bowl (13) is level. When oriented at the first angle (17), a person can also dismount the toilet module with greater ease as they do not need to lift their body quite as far as when they are lifting from a horizontal toilet seat.

When the aft end (21) of the toilet module is lowered below the front end (19), for example when in the second position or orientated at the third angle (27), a person seated on the toilet module (11) will adopt something of a squatting posture. The squatting posture is also assisted by movable footrests (29) that can be raised to improve the squatting posture for the purpose of assisting with bowel cleansing.

It can be seen in the figures that the toilet bowl support mechanism (15) is configured to rotate the toilet bowl (13) about an axis of rotation (31) that passes through a point that is situated at or adjacent the front end (19) of the bowl (13). The axis of rotation (31) is parallel to a transverse axis of the toilet bowl (13).

In this example, the toilet bowl support mechanism (15) includes two bowl guides (33) that are configured to facilitate the movement of the toilet bowl (13) to and between the first position and the second position. The toilet bowl support mechanism (15) includes a bowl structural support member (35) that is rigidly connected to the toilet bowl (13) at a first or forward part (37) of the bowl structural support member (35) and which has a slidable engagement with the bowl guides (33) at a second or aft part (39) of the bowl structural member (35). In this way, the bowl structural support member (35) provides a cantilevered support for the toilet bowl (13).

Each of the bowl guides (33) includes a curved section of guide rail (41). The bowl guides (33) are aligned in a substantially vertical orientation. The curved section of the guide rails (41) is used to produce the rotational movement of the toilet bowl (13) about the axis of rotation (13) as the bowl structural support member (35) slides along the curved section of the guide rail (41). The toilet bowl (13) rotates about a radius (43) that is approximately equal to the distance from the front end (19) of the toilet bowl (13) to the curved section of the guide rails (41).

The toilet bowl (13) is generally situated higher when in the first position when compared to the situation of the toilet bowl (13) when in the second position. And the toilet bowl support mechanism (15) includes a spring (45) which is configured to bias or lift the toilet bowl (13) toward the first position. The toilet bowl support mechanism (15) also includes a powered actuator (47) that is configured to lift the toilet bowl (13) up and down, or to move it between the first position and the second position. In this example, the toilet bowl support mechanism (15) also includes a manually operated actuator having a long handle (49) that is configured to lift the toilet bowl (13) up and down. The powered actuator (47) and/or the handle (49) operate via a rack and pinion geared actuation system (50) to move the bowl structural support member (35) and thereby move and rotate the toilet bowl (13) about its axis of rotation (35). A hydraulic or gas filled damping strut (55) is used to control or slow down the up and down movement of the toilet bowl (13).

The bowl guides (33) are in the form of a rail (51) along which a carriage assembly (not shown) can move. The bowl structural support member (35) is connected to the carriage assembly that moves along its associated bowl guide (33). The carriage assembly provides the 'slidable engagement' between the bowl structural support member (35) and the bowl guides (33) noted herein.

As noted above, the toilet module (11) also includes movable footrests (29). A footrest support mechanism (61) supports the foot rests (29) and is configured to move the footrests (29) to and between an upper position and a lower position. The lower position is when the footrests (29) are at or near floor level, and the upper position is when the footrests (29) are raised by approximately one hundred and fifty to two hundred and fifty millimetres above the floor to assist a person in achieving a squat-like posture while seated on the toilet module (11).

The footrest support mechanism (61) includes two vertical footrest guides (63) that are configured to facilitate the movement of the footrests (29) to and between the upper position and the lower position. In this example, the footrest guides (63) are each an extension of the bowl guides (33), the curved bowl guides (33) being situated directly above the straight and substantially vertical sections of the footrest guides (63).

The footrest support mechanism (61) includes a footrest structural support member (67) that is rigidly connected to each footrest (29) at a first or forward part of the footrest structural support member (67) and which has a slidable engagement with the footrest guides (63) at a second or aft part of the footrest structural member (67). In this way, the footrest structural support member (67) provides a cantilevered support for the footrests (29).

The slidable engagement between the footrest structural member (67) and the footrest guides (63) is provided by a pair of carriage assemblies (68) that are able to move up and down each rail of each footrest guide (63). The footrest structural support member (67) is rigidly connected to the carriage assemblies (68). The footrest structural support member (67) includes a crossbar (69) which spans between the two carriage assemblies (68) and which helps to ensure that both footrests (29) move in unison.

The footrest support mechanism (61) also includes a powered actuator that is configured to move the footrests (29) to and between the lower position and the upper position. The footrest support mechanism (61) also uses the rack and pinion geared actuation system (50) to move the footrest structural support member (67) and thereby move the footrests (29). The footrest support mechanism (61) also utilises the spring (45) to bias the footrests (29) toward their upper position. The footrest support mechanism (61) can also use the handle (49) to manually move the footrests (29) to and between their lower and upper positions.

The toilet module (11) includes a trap (71) that is configured to provide a water seal or odour barrier in a waste outlet passage (73) of the toilet module (11). The direction of flow through the trap (71) is a direction that is parallel to the axis of rotation (31) of the toilet bowl (13). In this example the trap (71) includes an inverted U-bend which maintains a pre-determined level of water (74) in the toilet bowl (13). And since the direction of flow through the trap (71) is a direction that is parallel to the axis of rotation (31), the level of water in the toilet bowl (13) that is maintained by the U-bend is largely unaffected by the rotation of the toilet bowl (13) about the axis of rotation (31).

The toilet module (11) includes a flexible connection (not shown) that provides a water-tight connection between an outlet (75) of the toilet bowl (13) and a waste water system in the vicinity of the toilet module (11). The flexible connection allows the toilet bowl (13) to move without breaking a water-tight connection between the toilet bowl (13) and the waste water system.

The toilet module can be used in a number of ways. For example, a person who just has difficulty lowering themselves onto a toilet seat can raise the toilet bowl to its first position while they engage with the module, and then lower the bowl to its horizontal position for use in the conventional manner.

A person who is having difficulty cleansing their bowel can optionally move the toilet bowl to its second position, and then either partially or fully raise the footrests, to assist in adopting a squat-like posture.

Second Example

Figure 7:
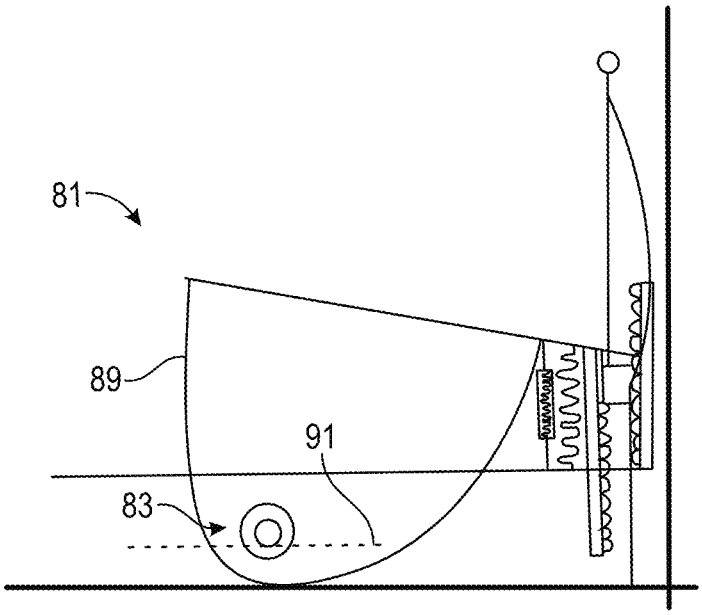
FIG. 7 is a side elevation view of a second example of a toilet module according to the present invention.
Figure 8:
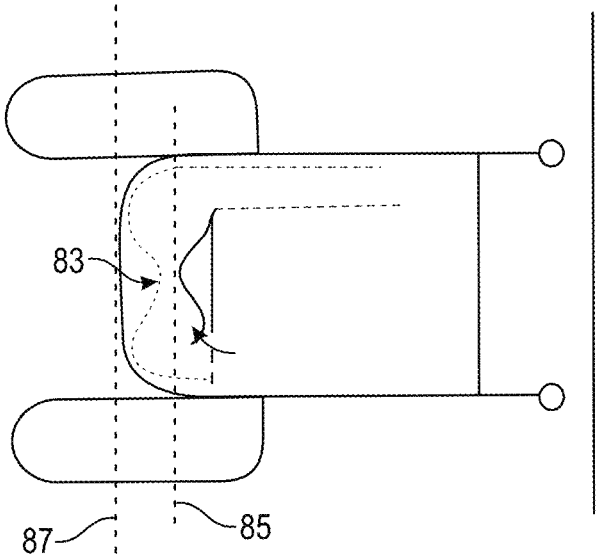
FIG. 8 is a plan view of the second example of a toilet module.
Figure 9:
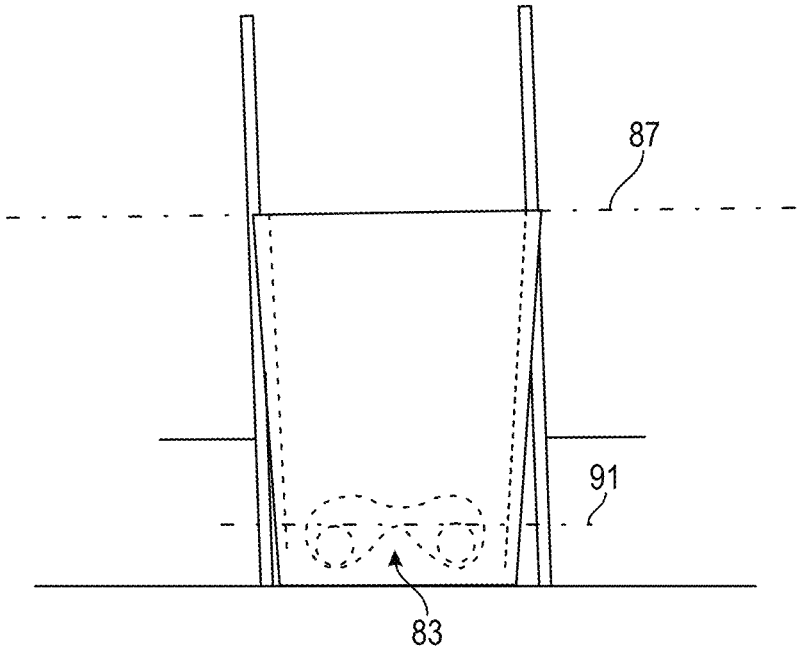
FIG. 9 is a front elevation view the second example of a toilet module, FIG. 10 a side elevation view of a third example of a toilet module according to the present invention.

With reference to FIGS. 7 to 9, a second example of a toilet module (81) will now be described. The second example of a toilet module (81) is similar in all aspects to the first example of a toilet module (11) described herein, except that is has an alternative trap configuration.

Instead of the inverted U-bend of the first example, the trap of toilet module (81) includes an hour glass shaped waisted section (83). A principal axis (85) of the hour glass shaped waisted section (83) is parallel to the axis of rotation (87) of the toilet bowl (89). The idea of the hour glass shaped waisted section (83) is that as the orientation of the toilet bowl changes, a water level (91) within the toilet bowl (89) remains substantially the same, as the water level (91) is determined by the lowest part of the narrowest section of the hour glass shape.

Clearly, as an alternative to the full hourglass shape shown in the figures, a part hourglass shape could be used. For example, an upper third of the hourglass shape could be omitted, with the water level within the toilet bowl (89) being controlled by the lower two thirds of the hourglass shaped trap (83).

Third Example

Figure 10:
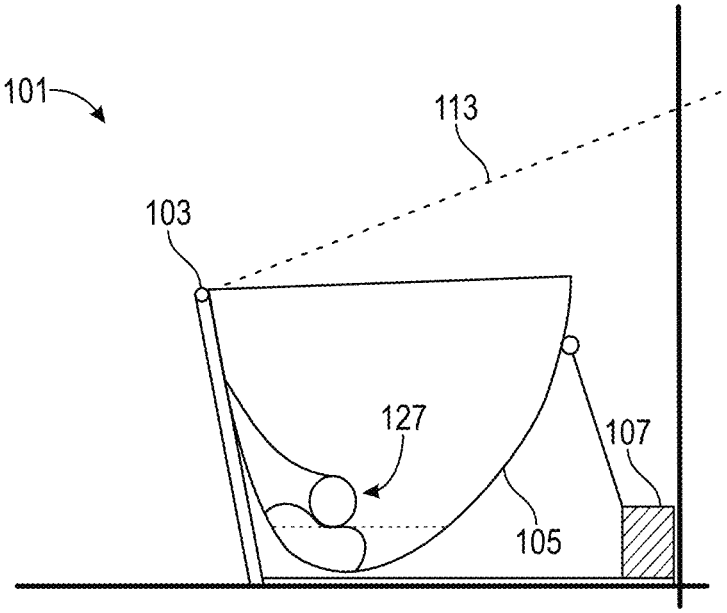
Figure 11:
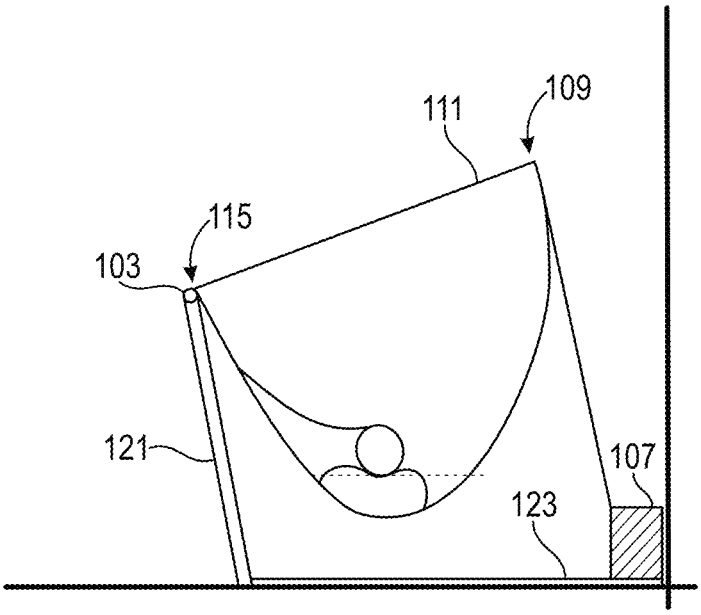
FIG. 11 is a side elevation view of the third example of a toilet module shown in a raised mode.
Figure 12:
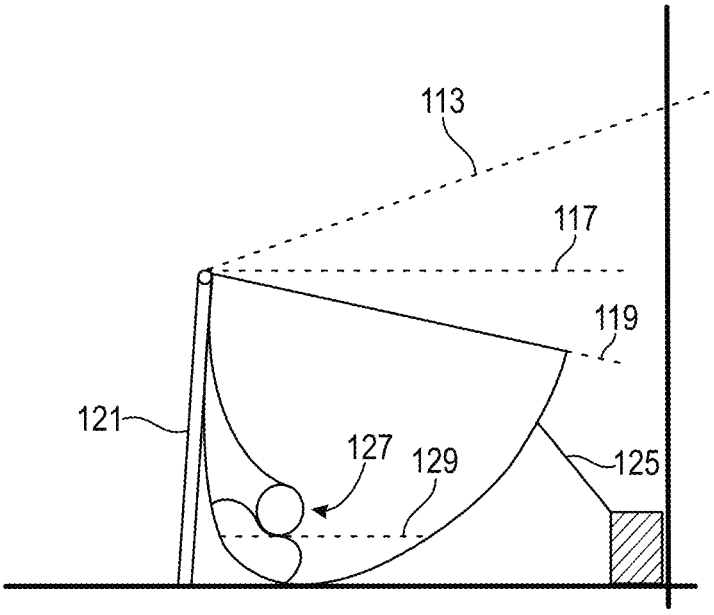
FIG. 12 is a side elevation view of the third example of a toilet module shown in a lowered mode.

With reference to FIGS. 10 to 12, a third example of a toilet module (101) will now be described. The third example of a toilet module (101) is similar in many aspects to the first and second examples of a toilet module (11) and (81) described herein. The main differences are the use of a forward pivot mechanism (103) in lieu of the toilet bowl support mechanism (15) of the first example, and the toilet module (101) has no footrests.

As with the earlier examples, a toilet bowl (105) of the toilet module (101) is movable and can be positioned at a range of angles relative to horizontal. In this example the toilet bowel (105) is supported by the forward pivot mechanism (103) and by a toilet bowl lifting actuator (107). The toilet bowl lifting actuator (107) is configured to raise and lower an aft end (109) of the toilet bowel (105) in such a manner that a top or upper surface (111) of the toilet bowl (105), and its associated seat (not shown), can be orientated at a range of angles.

With reference to FIGS. 11 and 12, it can be seen that the toilet bowl (105) can be oriented at a first angle (113) in which a front end (115) of the toilet bowl (105) is lower than the aft end (109) of the toilet bowl (105). The toilet bowl (105) can also be oriented at a second angle (117) in which the top of the toilet bowl (111) is substantially level, and a third angle (119) in which the front end (115) of the toilet bowl (105) is higher than the aft end (109) of the toilet bowl (105).

The toilet bowl (105) is supported at its front end (115) by the pivot mechanism (103). The pivot mechanism (103) itself is supported on a substantially vertical support member (121), which can be in the form of a metal column or front wall of the toilet module (101). A base member (123), which in this case is in the form of a metal bar or tray, supports the vertical support member (121) at its forward end, and supports the lifting actuator (107) at its aft end.

The lifting actuator (107) is coupled using a connecting rod (125) to the aft end (109) of the toilet bowl (105). In this way, operation of the lifting actuator (107), which is a linear actuator, is used to raise or lower the aft end (109) of the toilet bowl (111), and to move the top of the toilet bowl (105) to any angle between the first angle (113) and the third angle (119). The pivot mechanism (103), the vertical support member (121), the base member (123) and the lifting actuator (107) form a toilet bowl support mechanism of the third example of a toilet module (101).

The third example of a toilet module (101) has a similar trap (127) configuration, to maintain a desired water level (129) within the bowl (105), as that described with reference to the first example herein.

Variations

To those skilled in the art to which the invention relates, many changes in construction and widely differing embodiments and applications of the invention will suggest themselves without departing from the scope of the invention as defined in the appended claims. The disclosures and the description herein are purely illustrative and are not intended to be in any sense limiting.

In the first example described herein, the toilet module (11) includes two bowl guides (33) and two footrest guides (63). In an alternative configuration, the toilet module (11) could include one, or more than two bowl guides (33) or two footrest guides (63).

The toilet modules (11), (81) and (101), shown in the drawings have a flat seat, however, as an option, the toilet modules (11), (81) and (101), could include a seat having a concave upper surface, that is, a concave upper surface when the seat is viewed in a side elevation.

Definitions

To avoid confusion, it should be noted that the terms front end (19) and aft end (21) which refer to the front and aft ends of the toilet bowl (13), correspond to the front and the back respectively of a person when seated on the toilet module (11). That is, the terms front end (19) and aft end (21) are relative to a person seated on the toilet module (11).

Also, it should be noted that the front end (19) and the aft end (21) of the toilet bowl (13) are each points that are situated at or adjacent the upper surface (25) of the toilet bowl (13).

Throughout this specification the word "comprise" and variations of that word, such as "comprises" and "comprising", are not intended to exclude other additives, components, integers or steps.

ADVANTAGES

Thus it can be seen that at least the preferred form of the invention provides a toilet module which has the following advantages;

- the toilet module allows a person to cleanse their bowels in a squatting posture,
- the toilet module can be used by people who have difficulty sitting on, or lifting from, a conventional toilet seat, and
- the toilet module provides the above mentioned advantages while providing a sanitary toileting apparatus that is also aesthetically pleasing.

The invention claimed is:

1. A toilet module comprising:

a toilet bowl; and a toilet bowl support mechanism, the toilet bowl being supported by the toilet bowl support mechanism, wherein the toilet bowl has a front end and an aft end, the front end and the aft end corresponding to a front and a back respectively of a person seated on the toilet module when the toilet module is in use, the front end and the aft end each being situated at or adjacent an upper surface of the toilet bowl, wherein the toilet bowl support mechanism is configured to rotate the toilet bowl to and between a first position and a second position about an axis of rotation that passes through a point that is situated at a top of the front end of the bowl, wherein in the first position the front end of the toilet bowl is lower than the aft end of the toilet bowl, and wherein in the second position the front end of the toilet bowl is above the aft end of the toilet bowl.

2. The toilet module as claimed in claim 1, wherein the axis of rotation of the toilet bowl is parallel to a transverse axis of the toilet bowl.

3. The toilet module as claimed in claim 2, wherein the toilet module includes a trap configured to provide a water seal in a waste outlet passage of the toilet module.

4. The toilet module as claimed in claim 3, wherein a direction of flow through the trap is a direction that is parallel to the axis of rotation of the toilet bowl.

5. The toilet module as claimed in claim 4, wherein the toilet module includes a flexible connection that provides a water-tight connection between an outlet of the toilet bowl and a waste system in the vicinity of the toilet module.

6. The toilet module as claimed in claim 4, wherein the toilet bowl support mechanism includes one or more powered actuators configured to move the toilet bowl to and between the first position and the second position.

7. The toilet module as claimed in claim 4, wherein the toilet bowl support mechanism includes one or more bowl guides configured to facilitate the movement of the toilet bowl to and between the first position and the second position.

8. The toilet module as claimed in claim 7, wherein the toilet bowl support mechanism includes a bowl structural support member that is rigidly connected to the toilet bowl at a first or forward part of the bowl structural support member and which has a slidable engagement with the one or more bowl guides at a second or aft part of the bowl structural support member.

9. The toilet module as claimed in claim 8, wherein the bowl structural support member provides a cantilevered support for the toilet bowl.

10. The toilet module as claimed in claim 9, wherein each of the one or more bowl guides includes a curved guide section.

11. The toilet module as claimed in claim 10, wherein the one or more bowl guides extend in a vertical orientation.

12. The toilet module as claimed in claim 11, wherein each of the curved guide sections of the one or more bowl guides is used to produce the rotational movement of the toilet bowl as the bowl structural support member slides along the curved guide section of the one or more bowl guides.

13. The toilet module as claimed in claim 12, wherein the toilet bowl support mechanism includes at least one spring which is configured to bias the toilet bowl toward the first position.

14. The toilet module as claimed in claim 12, wherein the toilet bowl support mechanism includes one or more powered actuators configured to move the toilet bowl to and between the first position and the second position.

15. The toilet module as claimed in claim 12, wherein each of the one or more bowl guides is in the form of a rail along which a carriage assembly can move.

16. The toilet module as claimed in claim 12, wherein the bowl structural support member is connected to a carriage assembly that moves along the one or more bowl guides.

17. The toilet module as claimed in claim 1, further comprising:

movable footrests; and a footrest support mechanism that is configured to move the footrests to and between an upper position and a lower position.

18. The toilet module as claimed in claim 17, wherein the footrest support mechanism includes one or more footrest guides configured to facilitate the movement of the footrests to and between the upper position and the lower position.

19. The toilet module as claimed in claim 18, wherein the footrest support mechanism includes one or more footrest structural support members that are rigidly connected to each footrest at a first or forward part of the one or each footrest structural support member and which have a slidable engagement with the one or each footrest guide at a second or aft part of the one or each footrest structural support member.

20. The toilet module as claimed in claim 19, wherein the one or more footrest structural support members provide a cantilevered support for the footrests.

21. The toilet module as claimed in claim 20, wherein the footrest support mechanism includes one or more powered actuators configured to move the footrests to and between the lower position and the upper position.

* * * * *